United States Patent [19]

LaFlame

[11] Patent Number: 4,634,032

[45] **Date of Patent: * Jan. 6, 1987**

[54] CARRIER FOR A PERCUSSION INSTRUMENT OR OTHER OBJECT

[76] Inventor: Thomas R. LaFlame, 107 Noble Ave., Pittsburgh, Pa. 15205

[ * ] Notice: The portion of the term of this patent subsequent to Jun. 12, 2001 has been disclaimed.

[21] Appl. No.: 604,165

[22] Filed: Apr. 26, 1984

Related U.S. Application Data

[63] Continuation-in-part of Ser. No. 385,292, Jun. 4, 1982, Pat. No. 4,453,442.

[51] Int. Cl.[4] ..... A45F 3/10

[52] U.S. Cl. ..... 224/265; 84/421; 224/910

[58] Field of Search ..... 84/411, 418, 419, 420, 84/421; 224/910, 262, 270, 265

[56] References Cited

U.S. PATENT DOCUMENTS

| | | | |
|---|---|---|---|
| 3,106,123 | 10/1963 | Johannsen | 224/910 |
| 4,256,007 | 3/1981 | Streit | 84/421 |
| 4,387,839 | 6/1983 | Dranchak | 224/910 |
| 4,402,441 | 9/1983 | Jones et al. | 274/220 |
| 4,450,993 | 5/1984 | Ephraim | 224/910 |
| 4,453,442 | 6/1984 | LaFlame | 84/421 |

*Primary Examiner*—Stephen Marcus
*Assistant Examiner*—David Voorhees
*Attorney, Agent, or Firm*—Thomas H. Murray; Clifford A. Poff

[57] ABSTRACT

Apparatus for carrying an object, such as a percussion instrument, a backpack or a tray, includes a belly plate with a carrier extending outwardly therefrom to support the object in a generally overhanging position from a person. A rigid band extends along one or both sides of the person at the waistline area from the belly plate to the back of the person. A back-plate riser arm extends upwardly generally parallel to the spine of a person to apply a reactive force to the load at the thoracic region generally below the scapula region or at the sternum region. A pad assembly is adjustably positioned on the riser arms to engage the person's back or chest. A releasable latch interconnects the rigid band and the belly plate. A carrier bracket is releasably supported by the belly plate by engaging latch pins in notches located at opposite sides of a lock plate.

11 Claims, 21 Drawing Figures

CARRIER FOR A PERCUSSION INSTRUMENT OR OTHER OBJECT

CROSS-REFERENCE TO RELATED APPLICATION

This application is a continuation-in-part of application Ser. No. 385,292, filed June 4, 1982, now U.S. Pat. No. 4,453,442.

BACKGROUND OF THE INVENTION

This invention relates to an apparatus for carrying an obJect such as a percussion instrument, particularly drums; a work tray for tradesmen or a carrier for a backpack. More particularly, the present invention relates to a carrier device embodying a construction and relationship of parts to transfer forces due to, inter alia, the weight of a burden to the body of a person carrying the burden in a manner so that the person can efficiently carry a burden; maintain a stable attitude while walking or marching about and avoid pressure or other forms of detrimental forces on the shoulders and lower back, lumbar region.

As is known in the art, a carrier for a percussion instrument generally takes the form of a frame-like structure that is suspended from the shoulders of a person by hooks or straps. The hooks engage with a T-shaped breastplate with a central leg extending to a riser attached to a belly plate. A carrier frame projects from the belly plate and any one of various forms of extension bars may be attached to the carrier frame for engaging the instrument or instruments It is a common practice to use such a carrier to support one or more of a variety of instruments that notably consist of one or more drums. The instrument may comprise marching bells, a xylophone, a vibraphone, a marimba, a timpani, chimes or the like. An example of such a carrier is disclosed in U.S. Pat. No. 3,106,123.

Instead of hook members to engage the shoulders, a shoulder harness made up of straps that pass over the shoulders of a person, crossing in the back and passing forwardly below the arms at the sides of the person, can be used to support a drum which is also connected to a belly plate by other straps. Examples of this type of carrier are shown in U.S. Pat. Nos. 3,021,744 and 3,974,732. Another form of an instrument carrier is shown in U.S. Pat. No. 4,256,007 and comprises a rigid metal rod with bent portions forming a pair of spaced-apart loops for engaging the shoulder blades of a marcher and a cooperating integral bent portion adapted to contact the back of the marcher to suspend the carrier from the player's torso. A pair of arm members projects from the frame at the back of a person forwardly to support the percussion instrument. A releasable belt is coupled between the opposite sides of the frame to secure the carrier to the marcher.

Because of the fact that percussion instruments must be carried at an outwardly-extended position from the marcher's body, the shoulders and the lower back of the person carrying the instrument are particularly vulnerable to fatigue. The stress and strain due to the overhung load can be detrimental to the person carrying the instrument. In recent times, the number, weight and types of instruments that are carried have increased. For example, four and sometimes six drums are carried by an individual. Other instruments which are supported by carriers which hang on the marcher's body include bells, a xylophone or a marimba, vibraphone, timpani and/or chimes which may have a weight of up to and sometimes exceeding 30 pounds. Sometimes an instrument or a group of instruments weighing up to 70 pounds must be carried. The weight of an instrument is applied to a marcher as a torque about the belly plate and forms a moment arm defined by shoulder straps or hooks. The marcher, almost inherently, shifts his or her lower torso forwardly as an offsetting measure to sustain the load produced by the overhanging weight. A similar condition may exit when a person carries an outwardly-extending load from the waist area while anchored at the shoulder area. Such a load condition on the human body causes fatigue in the lower lumbar region which the apparatus of the present invention is designed to at least substantially eliminate.

A person carrying a backpack also experiences abnormal loading on his or her lower torso. The load produced by the weight of a burden which is usually situated in an overhanging manner from the body causes the person to shift the lower torso region rearwardly as an offsetting measure. Examples of a backpack are equipment for camping, and compressed air canisters for an air mask. Numerous other articles are carried by attaching them to a support structure that is, in turn, attached for support by the body of a person at the thoracic region.

SUMMARY OF THE INVENTION

It is an object of the present invention to provide an apparatus for use by a person to support an object forming a burden by which reactive forces to the weight of the burden which may be carried in an outward or overhung manner from the person are applied to the thoracic or sternum region of the person about a pivot area normally contacted by a plate situated at the waistline region of the person.

More particularly, according to the present invention an apparatus is provided for use by a person to carry an object wherein the apparatus includes the combination of means including a carrier to receive an object for partial support at the waistline area of the person, a rigid band with a generally bent contour to extend along a portion of the waistline area of the person, a riser arm supported by the band to extend in a generally upward direction such that an upper end portion of the arm will extend along to an elevation generally at the thoracic or sternum region of the person, and means carried by the upper end portion of the arm for imparting to the person a reactive force to the weight of the object about the fulcrum area of contact with the person. The aforesaid means with a carrier bracket preferably includes a plate with a curved contour to conform to the contour of the waistline area of contact with the person.

In one embodiment of the apparatus of the present invention, the aforesaid back-plate riser arm angles upwardly from the side of the person to diagonally cross the spinal column at the thoracic region. In another embodiment of the present invention, the rigid band includes a back portion with at least one but preferably two bent side portions having terminal ends joined to a belly plate. The back-plate riser arm extends perpendicularly to the back portion in a generally parallel relation with the spinal column to the thoracic region of a person. A rectangular or square pad having a resilient surface is adjustably attached to the back-plate riser arm and forms the aforesaid means carried by the arm for imparting the reactive force to the person. The pad can be situated to engage the thoracic back region below the scapula back region or the sternum region of the chest which is generally opposite thereto.

Latch assemblies are constructed to permit quick disengagement of a carrier bracket from the belly plate. The latch assemblies include spaced-apart pins that can pass in notches at opposite sides of a latch plate. Other latches are constructed to faciliate disengagement of the belly plate from the rigid waistband. These latches include a lock shaft with a semi-circular part supported so that it can be rotated into one of a series of semi-circular grooves in the waistband. The lock shaft is supported by spaced-apart trunnions of a holder.

These features and advantages of the present invention as well as others will be more fully understood when the following description of the embodiments of the present invention is read in light of the accompanying drawings, in which.

Figure 1:
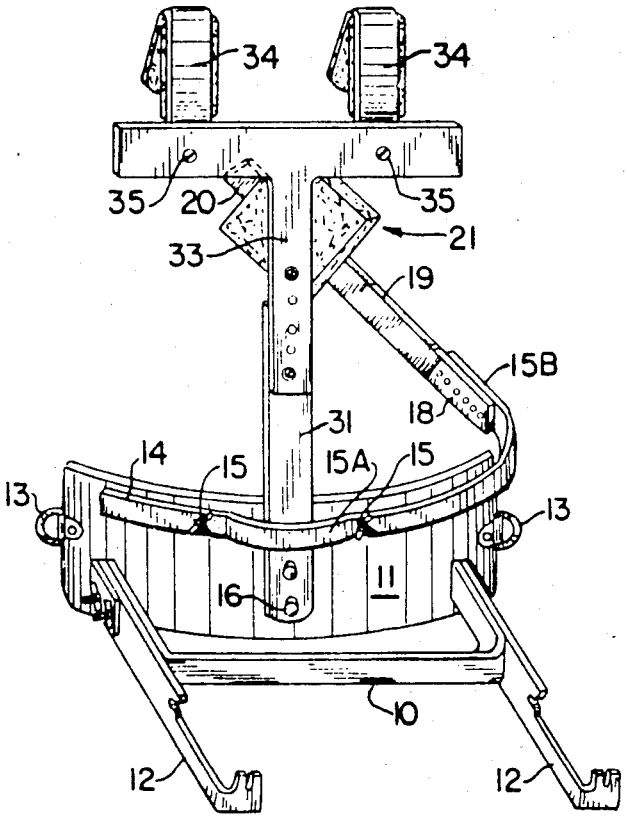
FIG. 1 is an isometric view of a carrier according to one embodiment of the present invention.

Turning, first, to FIG. 1 there is illustrated an apparatus for carrying an instrument. Any one of a number of different instruments such as marching bells, a marching xylophone or a marching marimba, may be engaged for support on the apparatus by the use of suitably-constructed extension arms. More than one drum may be supported by the use of the carrier according to the present invention. The apparatus in FIG. 1 includes a carrier frame 10 having the form of a U-shaped bent bar with the free ends of leg portions welded or otherwise attached to a belly plate 11. The carrier frame 10 is engaged with extension arms 12 which project from the belly plate along the leg portions of the carrier frame 10 outwardly where they engage and support the instrument, such as a marching xylophone, not shown. The belly plate 11 has a curved configuration to generally conform to the front waistline contour of a person. Fastening rings 13 are bolted to opposite lateral sides of plate 11. A waist plate 14 is affixed by fasteners 15 across the top portion of the belly plate. Vertically, spaced-apart attachment pins 16 extend from the belly plate at the center portion thereof. The waist plate takes the form of a rigid band with a curved portion 15A protruding outwardly from the belly plate for access to the attachment pins 16, the purpose of which will be explained in detail hereinafter. The inner face of the curved configuration of the belly plate which is opposite the face engaged with carrier frame 10, has a resilient comfort pad to cushion and distribute supporting engagement at the waistline area with a marcher. The configuration of the belly plate can be changed as necessary. If desired, a portion of the waist plate 14 can serve as a means for supporting an instrument at the front waistline area of a person. The waist plate 14 has a bent side section 15B with at least one but preferably two drilled openings therein that can be aligned with spaced-apart drilled openings in a lower end portion 18 of a back riser arm 19. Fasteners, such as nut and bolt assemblies, releasably interconnect the riser arm to the waist plate so that the riser arm is spaced from the belly plate by a distance which is sufficient to accommodate the size of the waistline area of a person. The riser arm 19 angles upwardly to present an end portion 20 generally diagonally with the spinal column of the person at the thoracic region. A back-plate assembly 21 is adjustably positioned on end portion 20 to present a load-bearing face of the plate at the thoracic back region generally below the scapula back region of the person.

Figure 3:
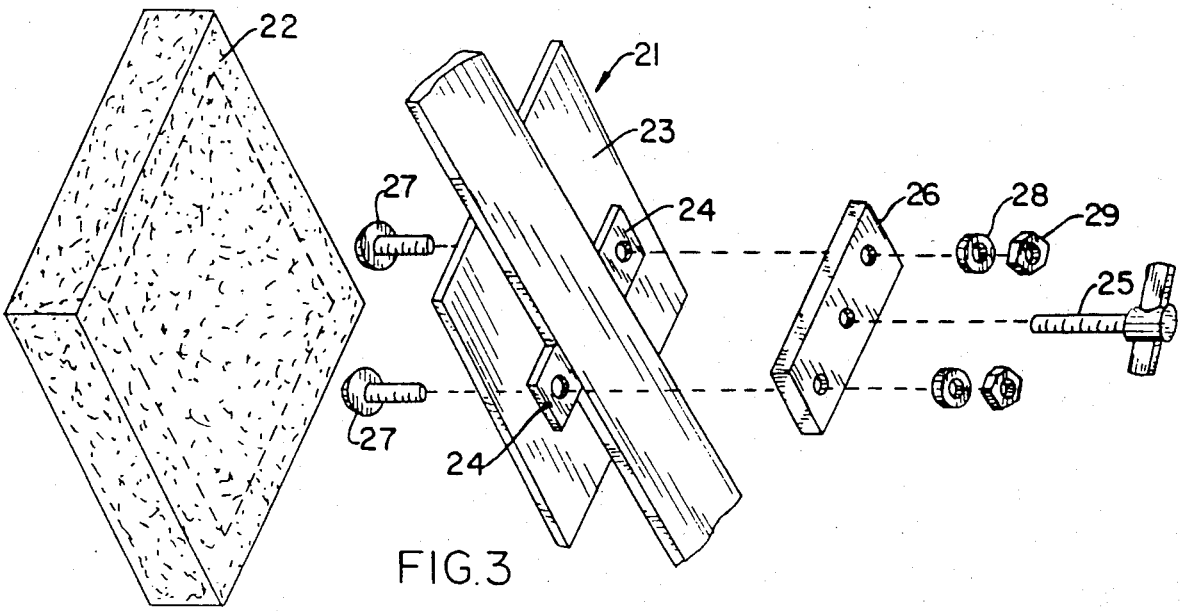
FIG. 3 is an exploded view illustrating the details of an adjustably-positioned back plate forming part of the carrier of the present invention.

As shown in FIG. 3, the back-plate assembly 21 includes a rectangularly-shaped resilient pad 22 having one face surface affixed by a suitable adhesive to a plate 23. The opposite face surface of plate 23 engages slide blocks 24 which are spaced apart by a distance corresponding to the width of the back-riser plate so that it can fit between the blocks where it is releasably clamped to the plate 23 by a clamp screw 25 passed through a threaded opening in a crossplate 26. Drilled openings in the crossplate 26, slide blocks 24 and back plate 23 are aligned to receive bolts 27 that are secured in place by washers 28 and nuts 29 at the crossplate. The slide blocks form spacers to hold the crossplate from the backriser plate so that only the threaded end portion of the fastener 25 can engage the back plate when passed through the crossplate.

Referring, again, to FIG. 1 the pins 16 engage with openings in a lower end portion of a front riser arm 31. The upper end of the riser arm has a series of drilled holes to receive threaded fasteners when aligned with drilled holes in the shank of a T-shaped breastplate 33. Oppositely-extending wing portions of the breastplate carry shoulder hooks 34 which are attached by threaded fasteners 35. The shoulder hooks 34 pass over the shoulders of a person to maintain the belly plate and waist plate at an elevation corresponding to the front waistline area. The weight of the instrument carried on arms 12 acts, about a fulcrum formed by the belly plate, to produce a reactive force on the resilient face of the back-plate assembly 21 against the thoracic region generally just below the scapula, i.e., just below the lower parts of the shoulder blades.

Figure 2:
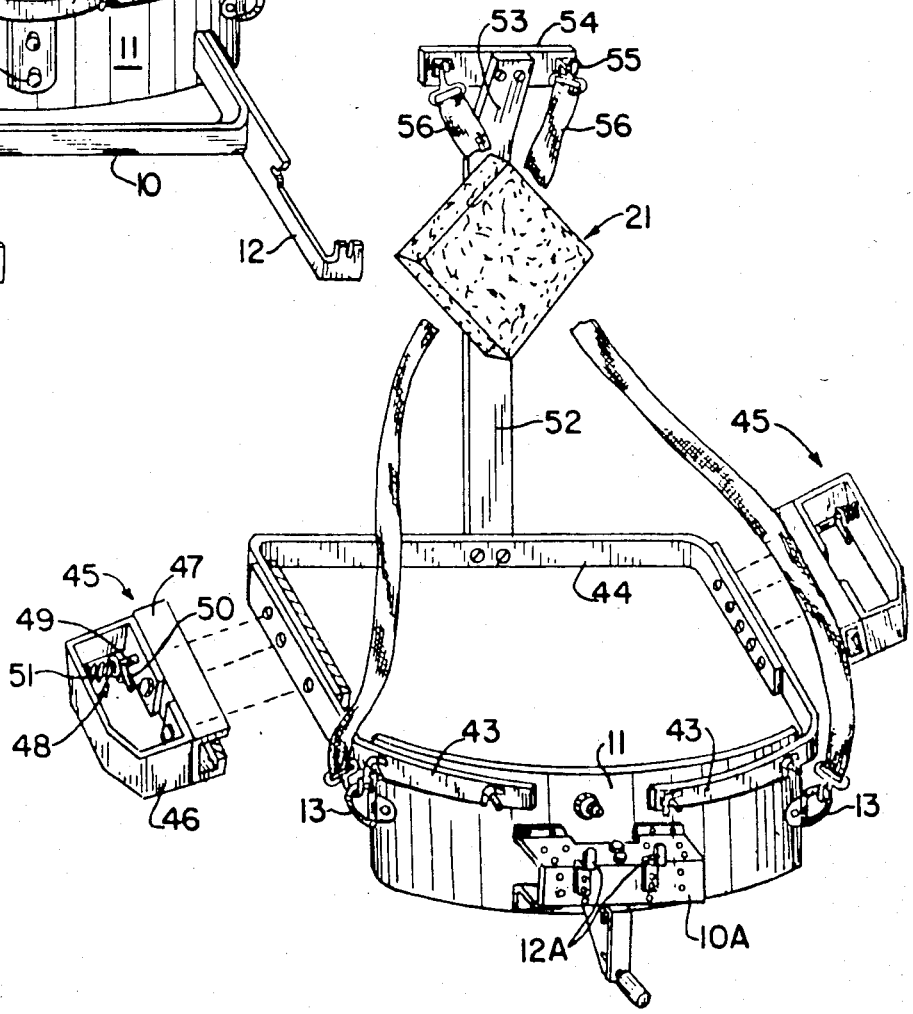
FIG. 2 is an isometric view of a carried according to a second embodiment of the present invention.

In FIG. 2, a further embodiment of the present invention is illustrated and includes belly plate which is substantially the same as belly plate 11 already described in regard to FIG. 1. Reference numeral 11 identifies the belly plate to which a carrier frame assembly 10A is attached by rivets or other fasteners. The carrier frame assembly carries hooks 12A to engage and support a snare drum. The embodiment of FIG. 2 includes a waist-plate assembly that passes along at least one side part but preferably encircles the waistline area at the sides and back of a person. The waist-plate assembly includes side portions 43 which are attached at end portions to the belly plate with their opposite ends bent to extend along the opposite sides of a marcher. The side portions 43 are joined with leg portions of a U-shaped back plate 44. Releasable latch assembly as 45 are used to hold the back plate to the side portions 43 at a preselected spacing from the belly plate. Each latch assembly includes a frame 46 engaged with a length of square tubing 47 into which side portions 43 extend and are secured thereto. A leg portion of back plate 44 can slide into the tubing. Frame 46, in turn, supports a springbiased lock pin assembly 48 having a lock pin 49 with an end portion that can pass through aligned openings in waist-plate portions 43 and 44. Assembly 48 includes an actuator arm 50 projecting from the lock pin s that the fingers of the person can apply a squeezing force to compress a spring 51 and withdraw the pin 49 from the aligned openings in waist-plate portions 43 and 44. The latch assembly has no loose parts and permits quick disengagement of the waist-plate portions.

A back riser arm 52 extends from the midportion of waist plate 44 in a generally perpendicular relationship such that the riser arm projects upwardly along a site which is generally parallel with the spinal column of the person traversing the thoracic region Back-plate assembly 21 embodies the same construction of parts as already described in regard to FIGS. 1 and 3 for adjustable support on the back riser arm and positioning at the thoracic region. End portion 53 of the back riser arm is curved forwardly and terminates generally at the upper part of the thoracic region, preferably before the cervical region of the person's spine. End portion 53 is engaged by threaded fasteners to support a crossbar 54 which carries spaced-apart eyelets 55 used to engage with hook members on the ends of straps 56. The straps pass forwardly over the shoulders of the marcher where they cross at the chest area and passed downwardly to engage with fastening rings 13.

Figure 4:
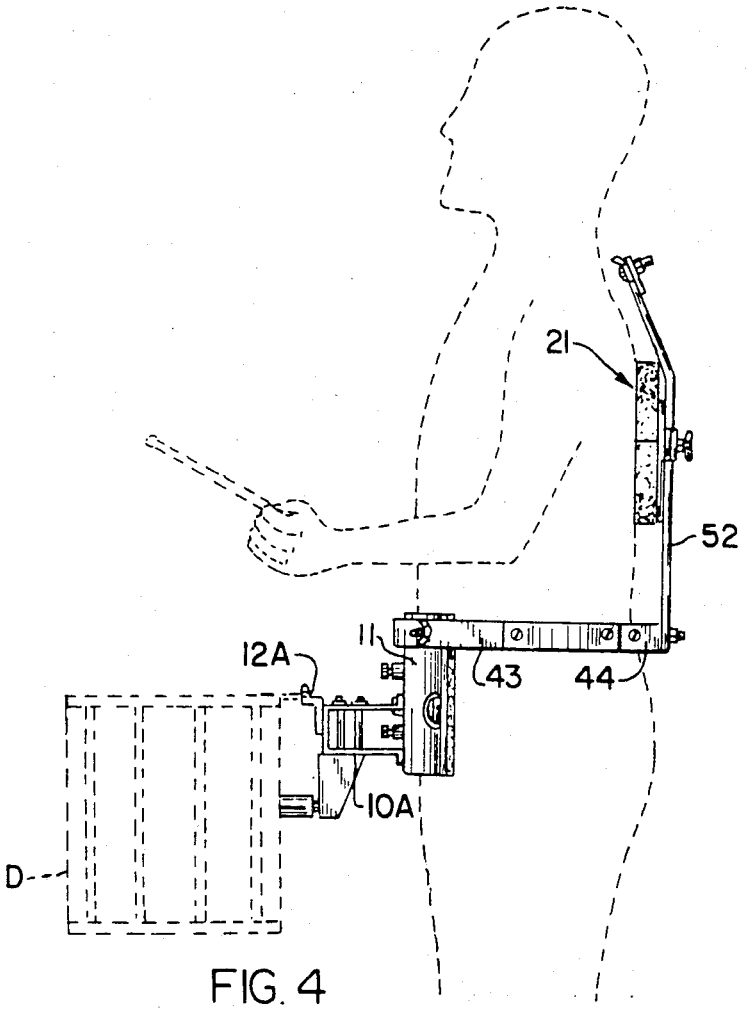
FIG. 4 is a left-side elevational view illustrating the upper torso of person while supporting a carrier according to the embodiment of the present invention shown in FIG. 2.

In FIG. 4 of the drawings, the manner by which the apparatus according to the present invention is supported by a person is illustrated with respect to the embodiment of FIG. 2. It can be seen that the belly plate 11 forms a fulcrum area by contact with the waistline area and upper belly region for the weight of an instrument, e.g., snare drum D which is carried at an outwardly-hanging relation by carrier assembly 12A. The downward force produced by the weight of the instrument is applied by a reactive force to the thoracic region of the person by back-plate assembly 21. The reactive force is transmitted by the waist-plate portions 43 and 44 and riser arm 52. The hooks 34 in the embodiment of FIG. 1 and straps 56 in the embodiment of FIG. 2 maintain the carrier so that the waist-plate portions extend along the general waistline area of the person and prevent downward movement of the carrier on the upper torso of the person.

Figure 5:
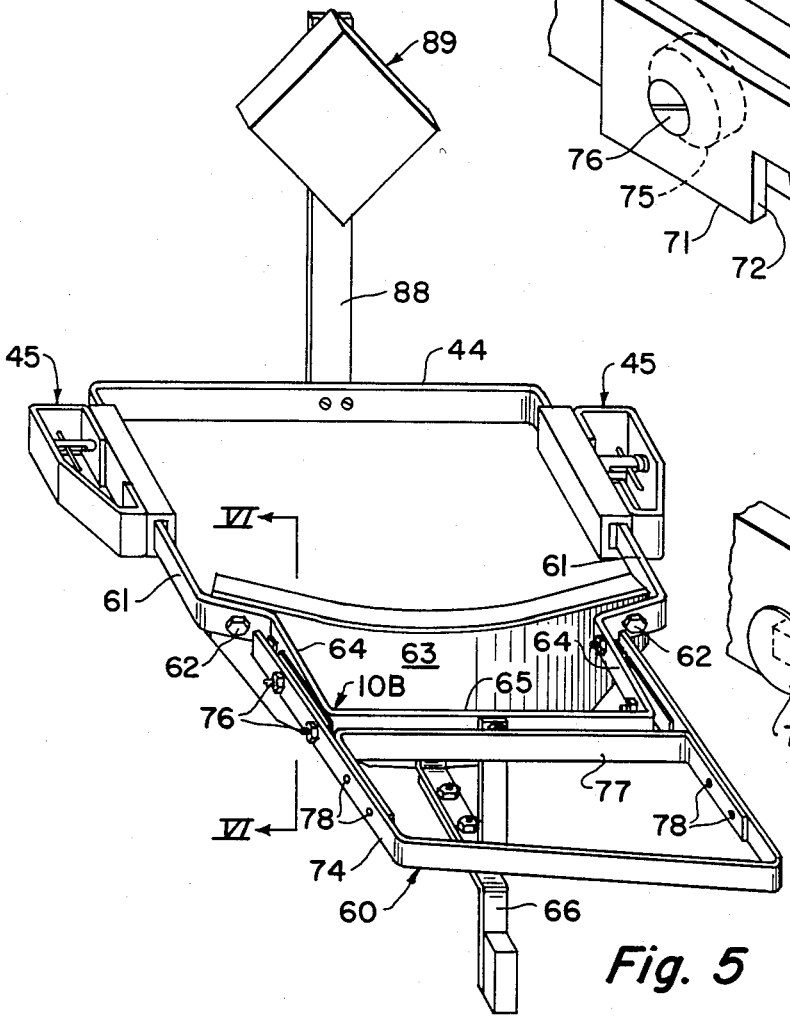
FIG. 5 is an isometric view of a carrier according to a third embodiment of the present invention.
Figure 9:
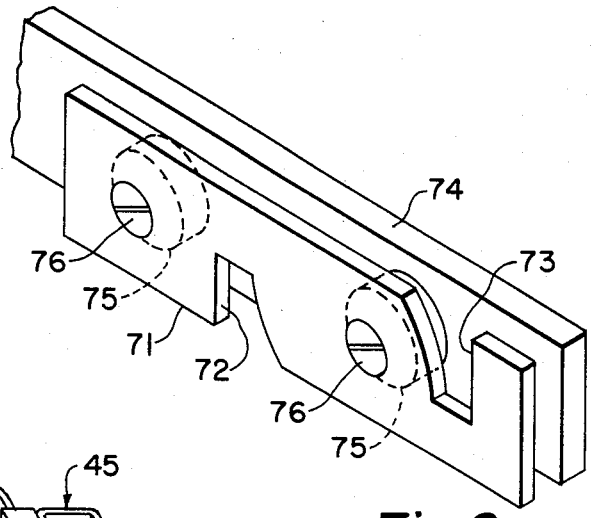
FIG. 9 is an enlarged isometric view of one embodiment of a frame latch assembly.
Figure 10:
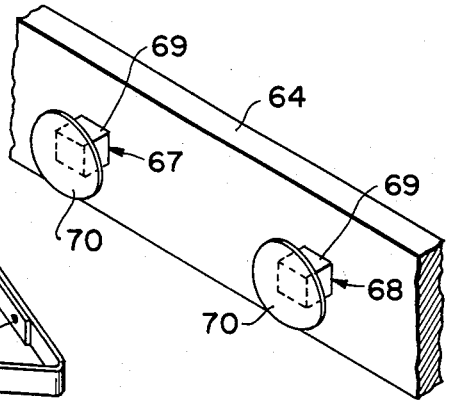
FIG. 10 is an enlarged isometric view of a carrier latch assembly for use with the frame latch shown in FIG. 9.
Figure 6:
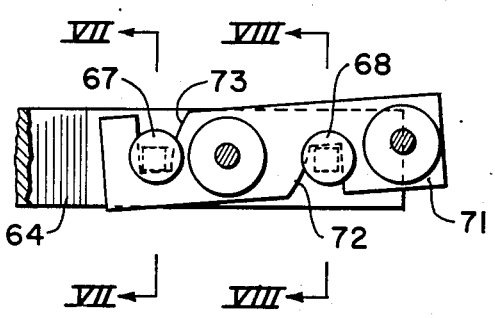
FIG. 6 is an elevational view taken along line VI—VI of FIG. 5.
Figure 7:
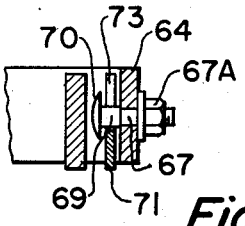
FIG. 7 is a sectional view taken along line VII—VII of FIG. 6.
Figure 8:
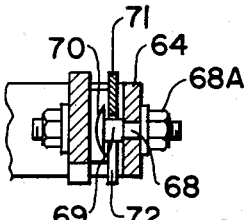
FIG. 8 is a sectional view taken along line VIII—VIII of FIG. 6.

In FIGS. 5-10, there is illustrated a disengageable carrier bracket 60 according to a further embodiment of the apparatus according to the present invention. In the same manner as shown in FIG. 2 and described previously, two latch assemblies 45 are used to releasably join the end parts of leg portions of U-shaped back plate 44 to side parts 61 which form part of a waist plate. The side parts 61 are joined by fasteners 62 such as nut and bolt assemblies to a belly plate 63. The side parts 61 extend outwardly from the belly plate where they form a carrier frame 10B generally comprised of side arms 64 and a front cross arm 65. A support pedestal 66 for an instrument, such as a drum, is connected by arms to cross arm 65 and the belly plate 63, as shown. The side arms 64, as shown in FIGS. 5–8 and 10, each includes spaced-apart latch pins 67 and 68 that have threaded end portions by which they are secured to the side arms by nut members 67A and 68A, respectively. The latch pins 67 and 68 each has a square shank 69 that extends from the side arm to a retaining collar 70. The retaining collars 70 extend along one side of a lock plate 71 when the square shanks of the latch pins are received in notches 72 and 73 in the lock plate. As shown in FIGS. 6 and 9, the notch 72 extends from one side edge to about the midportion of the lock plate 71 and the notch 73 extends from the opposite side edge to about the midportion of the lock plate. The lock plate is spaced from support arms 74 by collars 75. Threaded fasteners 76 hold the lock plate and collars to the support arms 74. The support arms form part of the carrier bracket 60 that further includes a spacer bar 77 also having a U-shaped configuration and is attached to the support arm fasteners 78. The frame can be readily connected and disconnected without the use of tools by angling the frame so that the notches 72 and 73 in the latch plate move out of an engaged relation with the latch pins 67 and 68.

Figure 11:
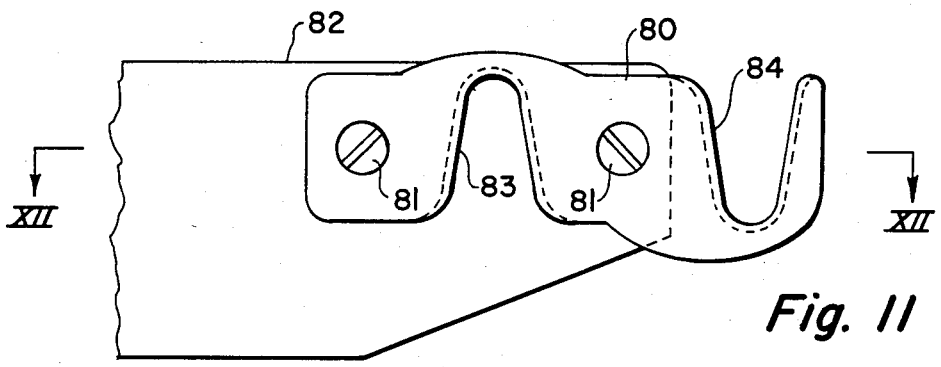
FIG. 11 is a side elevational view of a second embodiment of the frame latch assembly.
Figure 12:
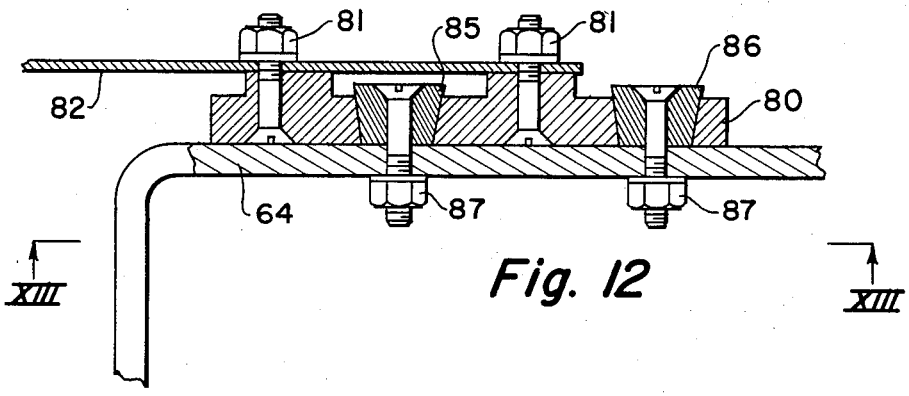
FIG. 12 is a sectional view taken along line XII—XII of FIG. 11 together with a carrier latch assembly.
Figure 13:
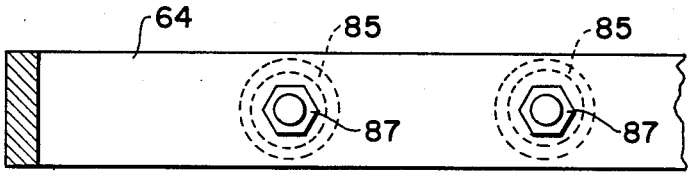
FIG. 13 is an elevational view taken along line XIII—XIII of FIG. 12 but illustrating only the carrier latch assembly.
Figure 14:
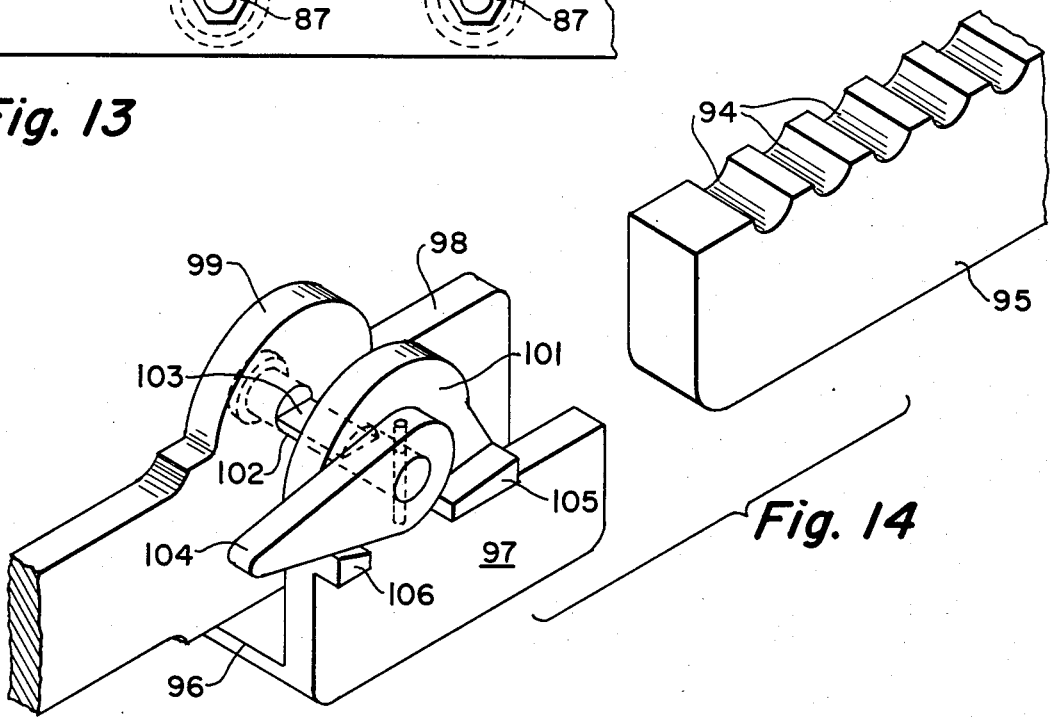
FIG. 14 is an enlarged isometric view of a further embodiment of a carrier release latch assembly.
Figure 15:
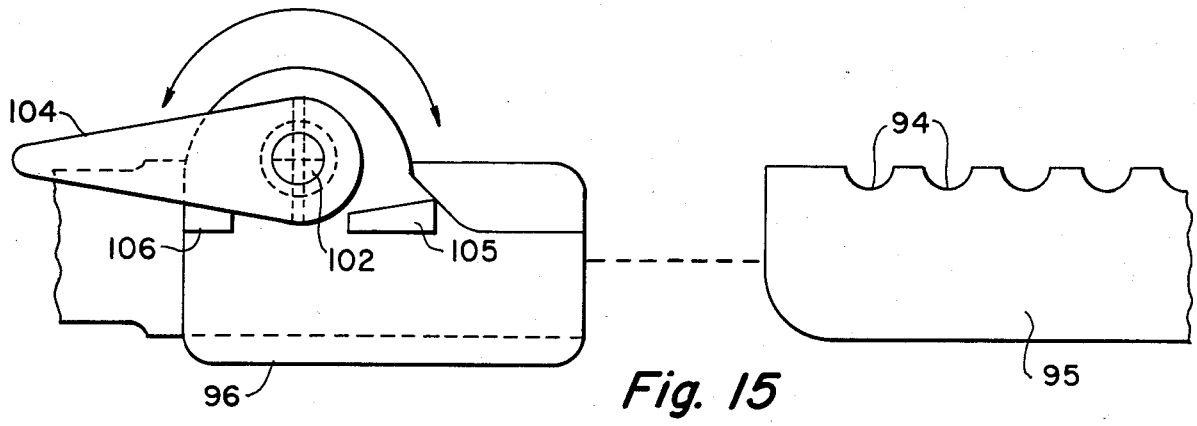
FIG. 15 is a side elevational view of the latch assembly shown in FIG. 14.
Figure 16:
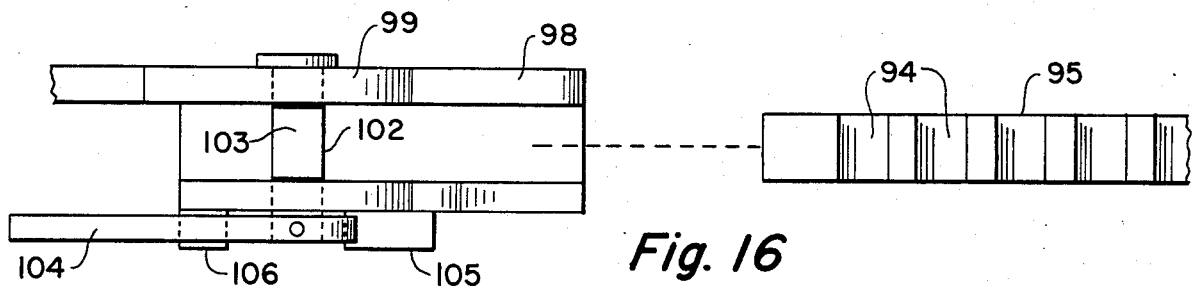
FIG. 16 is a plan view of the latch assembly shown in FIG. 14.

A further and preferred embodiment of a detachable carrier bracket for the apparatus of the present invention is shown in FIGS. 11–13 which includes a latch plate 80 which is preferably a casting embodying a design that avoids the need for spacers. The latch plate is connected by spaced-apart fastener assemblied 81 to a support arm 82 that forms part of a carrier bracket. It is to be understood that the support arm 82 is releasably attached to each side of the carrier bracket 10B (FIG. 5). The latch plate includes notches 83 and 84 that have tapered edges to receive the tapered sides of wedge blocks 85 and 86, respectively. Each wedge block is secured by a fastener assembly 87 to the side arms 64. The wedge blocks 85 and 86 are arranged to engage the tapered edges of the notches 83 and 84 and force the latch plate 80 against side arm 64.

Figure 18:
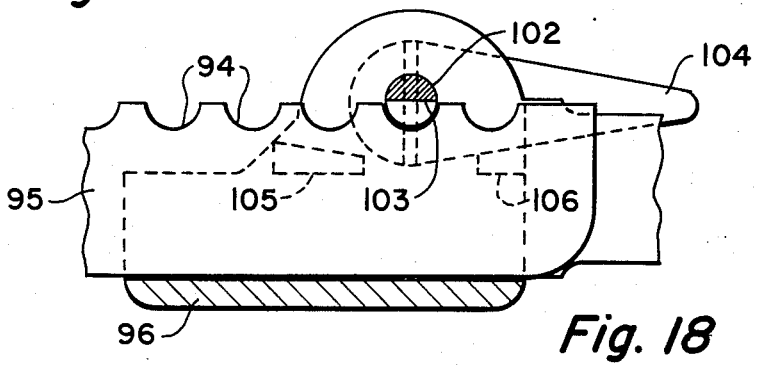
FIG. 18 is an elevational view, in section, of the latch assembly of FIG. 14 in a locked position of its parts.
Figure 19:
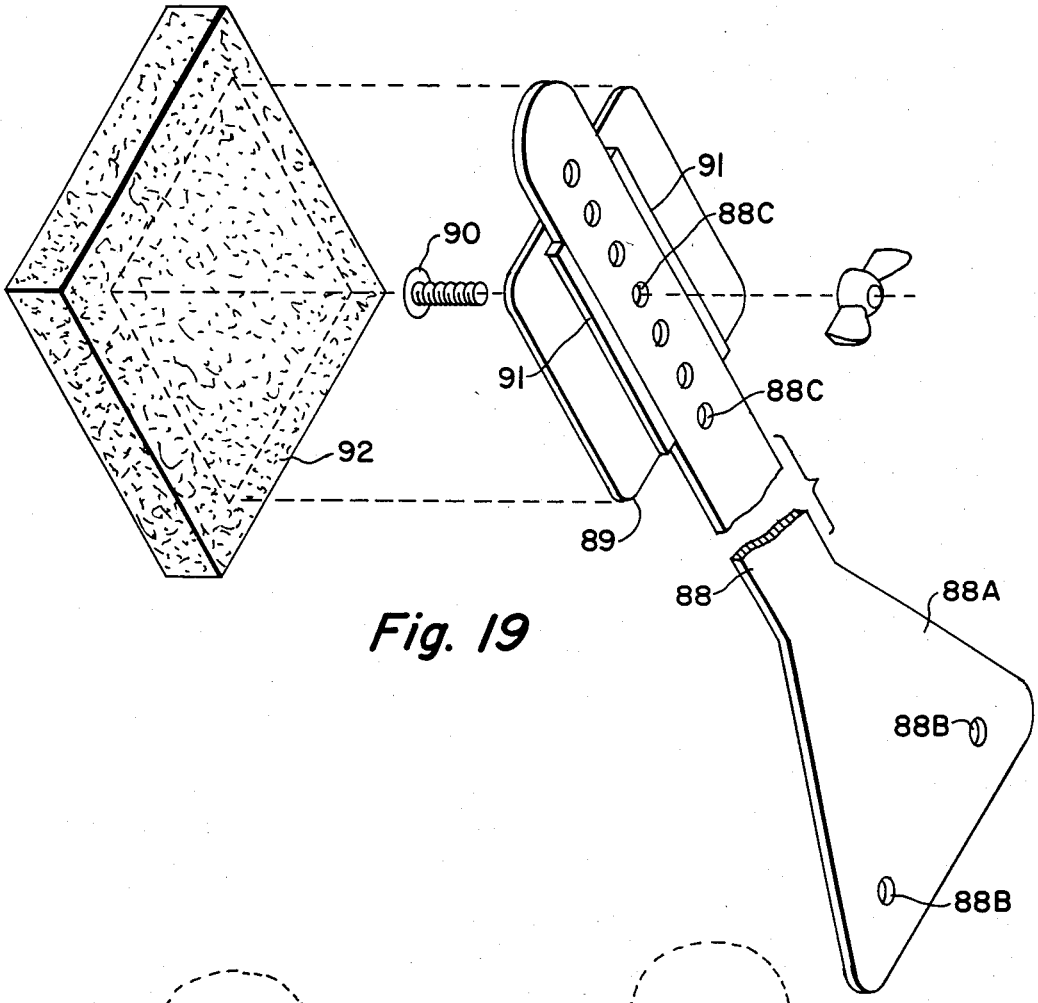
FIG. 19 is an isometric view of a preferred embodiment of the riser arm assembly forming part of the apparatus of the present invention.

Referring again to FIG. 5, the apparatus shown therein includes a riser arm which is identified by reference numeral 88 and carries at its upper end a back plate assembly 89. The details of the construction of the riser arm and back plate assembly are shown in FIG. 18. The riser arm takes the form of a plate member with an enlarged lower end portion 88A wherein two openings 88B are provided to receive threaded fasteners by which the riser arm is secured to back plate 44. A series of spaced-apart holes 88C is formed in the upper end portion of the riser arm. Any one of these holes can be aligned with a similar hole in the plate 89 and secured thereto by a threaded fastener assembly 90. Spaced-apart guide and anchor ribs 91 project from back face surface of the back plate and extend along opposite lateral sides of the upper portion of the riser arm. A rectangular slab 92 of foam rubber or other resilient material is adhered to a front face surface of the plate which is opposite the ribs 91.

Figure 17:
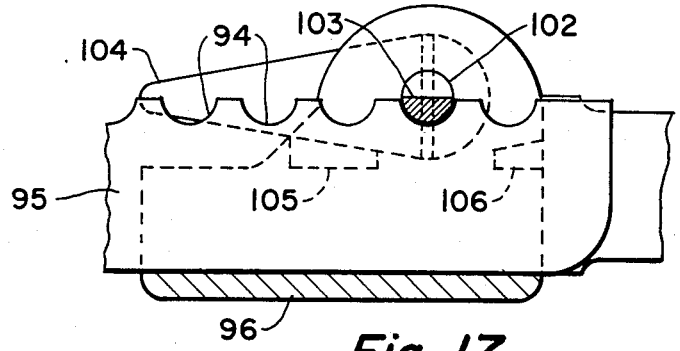
FIG. 17 is an elevational view, in section, of the latch assembly of FIG. 14 in an unlocked position of its parts.

In FIGS. 14–18, there is illustrated a preferred form of latch assembly for releasably interconnecting a U-shaped back plate with side parts of the waist plate forming part of the carrier assembly according to any of the embodiments described hereinbefore. The latch assembly includes a series of spaced-apart, semi-circular grooves 94 which are cut in the top edges of end portions 95 of a U-shaped back plate. The semi-circular grooves extend transverse to the extended length of the plate. The end portion of the plate can pass into an opening formed by a holder 96 having spaced-apart side walls 97 and 98 that include upstanding support trunnions 99 and 101, respectively. Side wall 98 is formed with an extended length for attachment to the belly plate. A lock shaft 102 is supported by the trunnions. The lock shaft is provided with a flat surface 103 so that when the shaft is rotated, the flat surface 103 moves from a position wherein it faces one of the semi-circular grooves 94, as shown in FIG. 17, into a locking position in which the semi-circular part of the shaft passes into one of the semi-circular grooves 94 as shown in FIG. 18. The shaft 102 is rotated by a lever arm 104 which is connected to the shaft by a lock pin. The lever arm is held in the locked and unlocked positions by ledges 105 and 106 which protrude from a trunnion 101.

The end portions 95 of the latch assembly shown in FIGS. 14–18 are, as described previously, part of the back plate which is first positioned to partly encircle the waist area of the user and then the belly plate with extended arms terminating at the holders 96 is moved into position so that the end portions 95 slide into the openings of the holders. A desired amount of space is then established between the back plate and the belly plate by moving the end portions 95 along the holders 96. Minor repositioning may be necessary to align the semi-circular slot to directly underlie the lock pin at each latch 1 assembly. Thereafter, the lever arm 104 is rotated to reposition the semi-circular part of the lock into the underlying slot. This locks the parts together which can be released by rotating the lock pins in the reverse direction.

Figure 20:
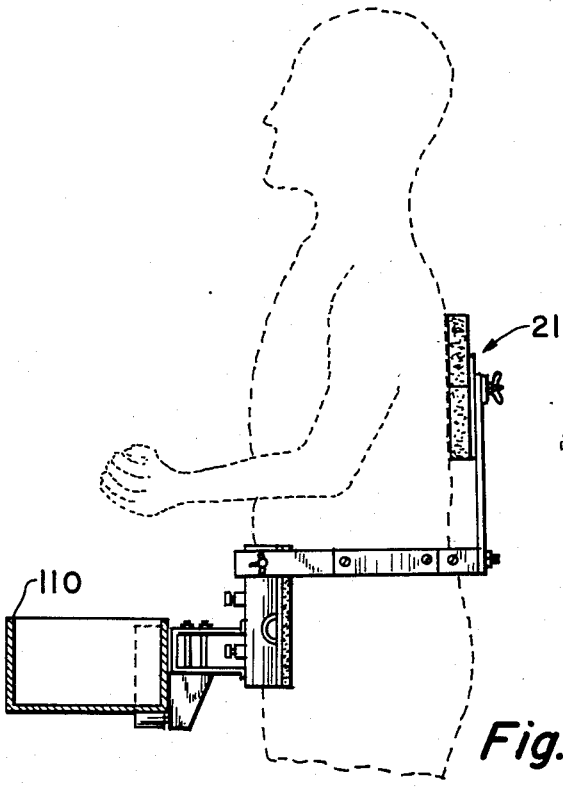
FIG. 20 is a view similar to FIG. 4 but illustrating use of the apparatus of the present invention for supporting a work tray.
Figure 21:
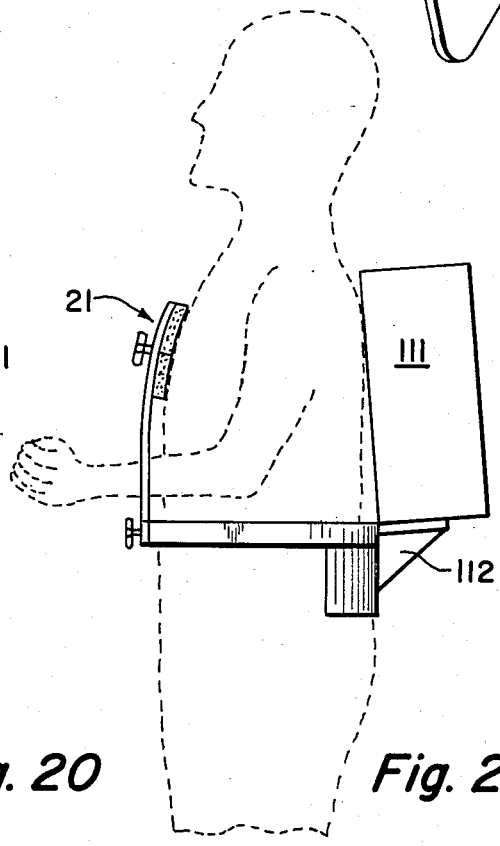
FIG. 21 is a view similar to FIG. 4 but illustrating use of the apparatus of the present invention for supporting a backpack.

In FIG. 20, the apparatus of the present invention which may be constructed according to any of the embodiments disclosed hereinbefore is illustrated for supporting a tray 110 typically comprised as an open top box. In substantially the same manner as described hereinbefore in regard to FIG. 4, the weight of an object in the box is applied to a fulcrum area by contact of the belly plate at the waistline area of a person so that a reaction force is applied to the thoracic region of the person by the back plate assembly 21. By repositioning of parts as shown in FIG. 21, a backpack 111 can be supported by a bracket 112 which is attached to the apparatus of the present invention. The bracket 112 is secured by fasteners to the belly plate. The belly plate is bent or shaped by other means for positioning so that it extends along, i.e., partly encircles, the back waistline area of the person with the band extending therefrom and encircling the waistline area of person. The back plate assembly is positioned on the riser arm to extend to the sternum region of the person's chest. The reactive force of the load imposed by the backpack on the apparatus is applied to the upper torso at an elevation generally corresponding to the sternum region and avoids an abnormal loading on the lower torso of the person.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. Apparatus for use by a person to carry an object, said apparatus including the combination of:
   - plate means for partial support at the waistline area of a person, said plate means including a carrier to receive an object,
   - means forming a rigid band with a generally bent contour supported by said plate means for extending from said plate means along at least a portion of the waistline of the person,
   - a riser arm supported by said band at the waistline of a person, said riser arm extending in a generally upward direction at a side of a person which opposite said plate means such that an upper end portion of the arm projects to an elevation generally at the thoracic region of the person, and
   - pad means carried by the upper end portion of said arm for imparting to the person a reactive force to the weight of said object about fulcrum area defined by a contact area of the plate means at the waistline area of the person.

2. The apparatus according to claim 1 further including latch means for releasably joining together said plate means and said rigid band.

3. The apparatus according to claim 2 wherein said latch means includes a holder having spaced-apart walls with trunnions rotatably supporting a latch shaft, said latch shaft having a semi-circular portion and a flat face surface, said rigid band including end portions with a series of spaced-apart recesses which can be received by said holder for engagement with said latch shaft.

4. The apparatus according to claim 1 further including a carrier bracket having support arms, releasable latches having pin members, and a latch plate having spaced-apart openings to receive said pin members for releasably securing said carrier bracket to said plate means.

5. The apparatus according to claim 4 wherein said latch plate has openings extending from opposite sides thereof for receiving said pin members.

6. The apparatus according to claim 5 wherein the openings in said latch plate are defined by tapered edges, and wherein said pin members comprise wedge blocks.

7. The apparatus according to claim 1 wherein said pad means includes a resilient pad member carried on a front face surface of a plate member for distributing said reactive force, said plate member having spaced-apart ribs on a back face surface extending along opposite sides of said riser arm for anchoring the riser arm to the plate member.

8. The apparatus according to claim 7 wherein said riser arm has a plurality of spaced-apart holes along an end portion which is extended from said band, fastener means received in one of said holes for releasably securing said plate member to said riser arm.

9. The apparatus according to claim 1 further including means supported by said plate means for carrying the object.

10. The apparatus according to claim 1 wherein said riser arm projects upwardly in a generally parallel relation with the spinal column of a person.

11. The apparatus according to claim 1 wherein said plate means is shaped to partly encircle the waistline at the back of a person.

* * * * *